US005383556A

United States Patent [19]

Van Loo

[11] Patent Number: 5,383,556

[45] Date of Patent: Jan. 24, 1995

[54] PACKING FOR SMALL OBJECTS WITH SLIDER CLOSURE

[75] Inventor: Brino A. Van Loo, Sassenheim, Netherlands

[73] Assignee: Stadium Design B.V., Hillegom, Netherlands

[21] Appl. No.: 59,254

[22] Filed: May 12, 1993

[30] Foreign Application Priority Data

Jun. 17, 1992 [NL] Netherlands ..... 9201070

[51] Int. Cl.[6] ..... B65D 85/24; B65D 43/20

[52] U.S. Cl. ..... 206/338; 206/468; 220/345; 220/350; 229/125.12; 229/220; 383/66; 383/81

[58] Field of Search ..... 206/338, 468; 220/345–351, 254, 258; 383/66, 69, 81; 229/125.12, 220

[56] References Cited

U.S. PATENT DOCUMENTS

| | | | |
|---|---|---|---|
| 172,431 | 1/1876 | Harwood | 220/345 |
| 2,445,650 | 7/1948 | Walker | 383/66 |
| 2,525,888 | 10/1950 | Freeman | 229/125.12 |
| 2,919,843 | 1/1960 | Farrell et al. | |
| 3,026,013 | 3/1962 | Ullrich et al. | 229/220 |
| 3,157,280 | 11/1964 | Perdue et al. | 206/468 |
| 3,382,972 | 5/1968 | Phipps | 206/468 |
| 3,756,387 | 8/1971 | Chaney | 220/345 X |
| 3,939,979 | 2/1976 | Neumayer | 206/468 X |

FOREIGN PATENT DOCUMENTS

| | | |
|---|---|---|
| 9200750 | 4/1992 | Germany . |
| 401356 | 4/1966 | Switzerland . |

*Primary Examiner*—Bryon P. Gehman
*Attorney, Agent, or Firm*—Foley & Lardner

[57] ABSTRACT

Packing in particular for small objects, such as sweets, screws and the like, which packing includes a packing unit (1, 23) which has been produced by folding a foil, sheet or plate (2, 22) and then bonding, welding and/or otherwise joining parts thereof, so that at least one wall (6, 32) of the packing unit obtained has two slots (7, 33), which, at least partially, are opposite each other, and a slider (8, 37) which is located in the slots and is formed by a plate of a sufficiently rigid material, so that this plate is slidable within the slots (7, 33) for covering or releasing an opening (9, 36) giving access to the interior of the packing unit (1, 23).

20 Claims, 1 Drawing Sheet

FIG. 1
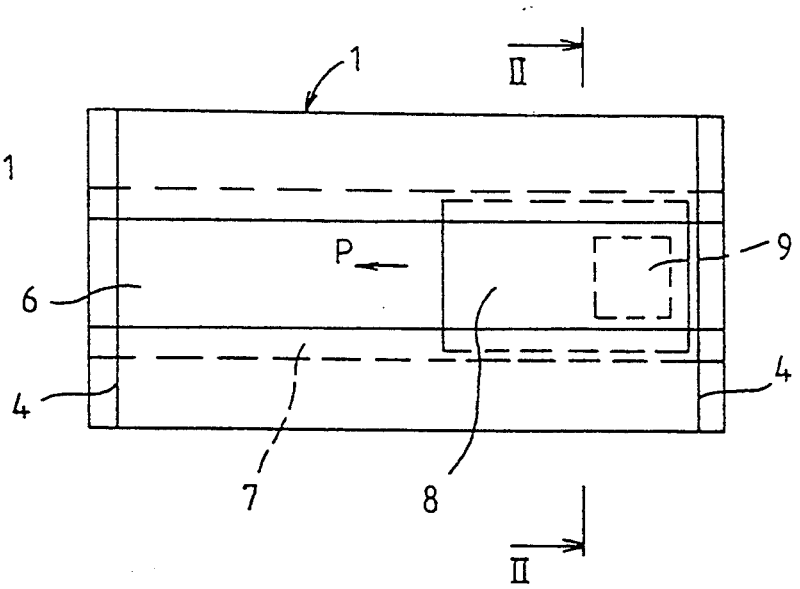
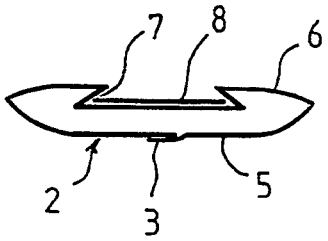
FIG. 2
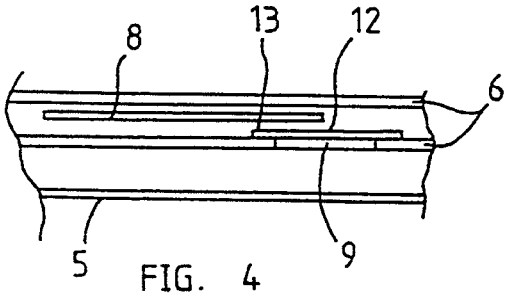
FIG. 4
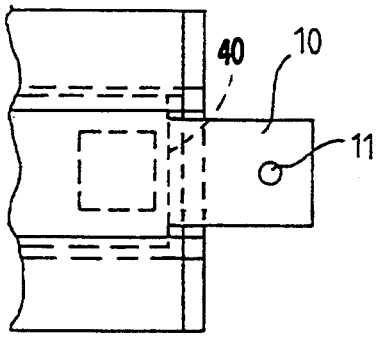
FIG. 3
FIG. 5
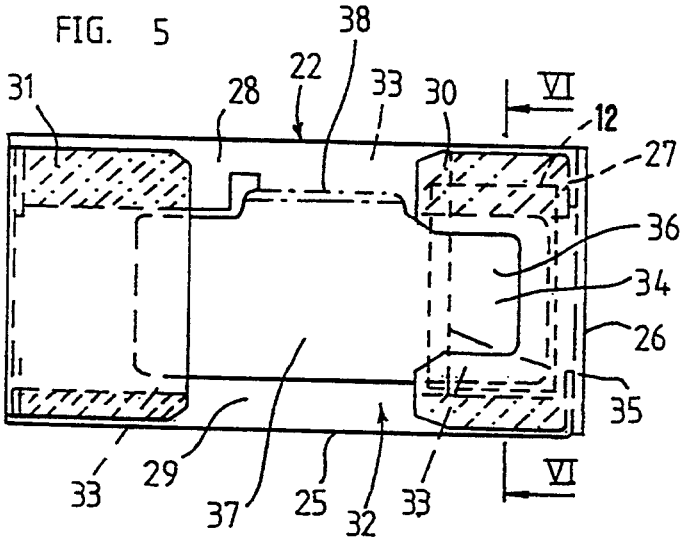
FIG. 6
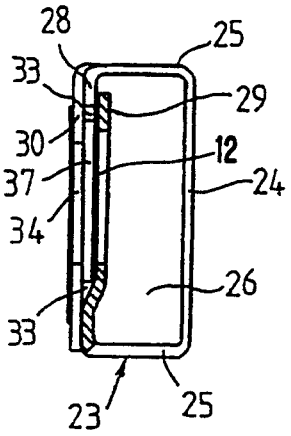

PACKING FOR SMALL OBJECTS WITH SLIDER CLOSURE

BACKGROUND OF THE INVENTION

The invention relates to a packing, in particular for small objects, such as sweets, screws and the like.

Recently, there has been an increasing consideration for the amount of packing material used in packing the above and many other objects, as well as of the biodegradability of the materials applied therein.

For example, chewing gum is often packed by the piece in a so-called "blister packing", in which each piece of chewing gum is located in a cavity of a plastic foil and the cavities are covered by an aluminium foil which is adhered to the plastic foil. Then, in addition a paper or cardboard case is slid over the whole, on which case generally a print has been applied.

It is obvious that this requires much packing material, which at least partly will not be biodegradable. One can think of the aluminium foil in particular. The production of aluminium requires much energy and owing to the established connection with the plastic foil, neither the plastic, nor the aluminium can be recovered and thus be recycled easily.

In many aspects, the same holds for e.g. the packing of chocolate sprinkles, artificial fertilizer and the like, in which one uses a cardboard box with an aluminium sprinkling spout provided therein, although here the amount of packing material is not as excessive as with the example stated above.

SUMMARY OF THE INVENTION

The object of the invention is to provide a packing which requires little material and which material is largely biodegradable.

To that end, the invention provides a packing which is characterized in that it comprises a packing unit which has been produced by folding a foil, sheet or plate and then bonding, welding and/or otherwise joining parts thereof, such that at least one wall of the packing unit obtained has two slots being, at least partially, opposite each other, and a slider which is located in the said slots and is in the form of a small plate of a sufficiently rigid material, such that this plate is slidable within the slots for covering or releasing an opening that gives access to the interior of the packing unit.

One can consider various plastics, paper, paper-like material or cardboard as material for the packing unit, the only requirement being that the material has enough rigidity to hold the slider in the slots. The size of the packing will also play a part. In case of a relatively small length of the slots, they are less likely to be able to move away from each other easily, and there will be no danger that the slider comes free from the packing unit unintentionally. To that end, obviously the slider itself must be sufficiently rigid and it will contribute to the rigidity of the packing unit as a whole.

One can think of transparent plastic as material for the packing unit, so that the consumer can see the contents of the packing. Certain types of plastic can be highly biodegradable.

In particular, one can think of thin cardboard as material for the slider, since this is biodegradable, and suitable for applying a print thereon as well, so that it need not be applied onto the plastic.

Obviously, it is advantageous when the packing unit and the slider have been made of the same material, though one can also think of a difference in thickness of the parts when these are produced separately.

In particular, it can be provided for, that the slider will be connected to the material of the packing unit when the packing is not opened.

One could think of applying a lip to the slider, which lip has been fixedly connected to the packing unit and can be torn loose therefrom. The lip can also be connected to the slider by means of a perforation.

Such a protruding lip can also be used to provide the packing with means for hanging it up.

According to another embodiment, it can be provided for, that the slider forms a whole with the packing unit and has been connected to the packing unit through a perforation or similar weakening line, along which the connection between the slider and the packing unit can be broken on opening the packing.

It is obvious that in this case the entire packing has been produced from one and the same material.

Further, the possibility exists, that the opening in the packing unit that gives access to the interior of the packing will remain closed off as long as the packing is not used. Then, on opening the packing, the opening is obtained in that a part of the wall of the packing unit is torn loose, or in that a cover foil provided across the opening and being connected to the wall of the packing unit, is removed.

This also has the advantage, that a packing still closed is almost air-tight, which in certain cases can be desirable.

The cover foil can partly be fixedly connected to the wall of the packing unit and on the other hand be releasably connected therewith, so that the opening, after having been used once, can be sealed anew by the cover foil. Such a possibility will for example be applied in combination with a slider, which, in the way described above, will be fixedly connected to the packing unit in the finished packing, so that one can check if the packing was opened before.

The releasable connection of the cover foil with the wall of the packing unit can be obtained in a known way by using an adhesive tape.

BRIEF DESCRIPTION OF THE DRAWINGS

The invention is further explained by way of embodiments, illustrated in the drawing, in which:

FIG. 1 shows a plan view of a packing according to the invention, in which it is in the closed position;

FIG. 2 shows a view of a cross-section according to the line II—II of FIG. 1;

FIG. 3 shows a part of a plan view of a packing which substantially corresponds to that of FIG. 1, but in which means for checking whether the packing was opened have been provided;

FIG. 4 shows a part of a longitudinal section of a packing in which means for closing the opening off again after use have been provided;

FIG. 5 shows a plan view of another embodiment of a packing according to the invention; and FIG. 6 shows a cross-section according to line VI—VI of FIG. 5.

DETAILED DESCRIPTION OF THE PREFERRED EMBODIMENTS

The packing shown in FIGS. 1 and 2 consists of the packing part 1 which has been obtained by folding a foil or sheet 2 a number of times, interconnecting the longitudinal edges at the seam 3 and sealing them at the ends by means fo the seams 4. The packing unit 1 now comprises a bottom wall 5 and an upper wall 6, which has been provided with two opposite slots 7. A slider 8 in the shape of a plate has been received in the slots 7 and is slidable in the slots. Due to this, an opening 9 provided in the upper wall 6 between the slots 7 can be covered by the slider 8 and be released on sliding the slider 8 in the direction of the arrow P.

FIG. 3 shows the possibility of providing the slider 8 with a lip 10, which is connected to the upper wall 6 of the packing unit 1, in particular at the seam 4. The lip 10 mounted to the slider 8 may be fixedly connected to the packing unit and can be torn loose therefrom, or may be connected to the slider by means of a perforation 40. Possibly, the connection of the lip 10 to the upper wall 6 can take place simultaneously with the provision of the seam 4.

The lip 10 can be provided with an opening 11 so that in a sales outlet a number of the packings can be slid onto a pin.

FIG. 4 shows the possibility of applying a cover foil 12 formed of an adhesive tape across the opening 9 in the upper wall 6. Along its one transverse wall 13, this cover foil 12 can be fixedly connected, and along its further walls be releasably connected to the upper wall 6 of the packing unit 1, so that each time after use, the opening 9 can be closed off again. The cover foil 12 can have a very small thickness, so that the slider 8 can easily be slid over it. In the way described by means of FIG. 3, the slider 8 can be reconnected to the upper wall 6, so that one can check whether the packing was opened before.

FIGS. 5 and 6 show a packing which has been folded from one sheet of material 22, such as for example a piece of thin cardboard. One obtains a packing unit 23, consisting of the bottom 24, upright longitudinal walls 25 and transverse walls 26, the longitudinal walls having been provided with lips 27 connected to the transverse walls 26. The longitudinal walls 25 have been folded over in order to obtain the parts 28 and 29, and the transverse walls 26 have been folded over in order to obtain the parts 30 and 31. The parts 28, 29, 30 and 31 together form the upper wall 32. The part 29 extends across almost the entire width of the upper wall 32 and up to beneath the narrow part 28, so that a slot 33 is obtained between the parts 28 and 29. The part 30 has been provided with the cutout 34 which together with the right-hand side boundary line 35 of the part 29 in the drawing forms the opening 36. Between the parts of the part 29 which are situated near the wall 25, and the parts 30 and 31, a slot has been formed, likewise indicated with 33 and consisting of two separate parts. The slider 37, being connected to the part 28 by means of a double perforation line with the perforation strip 38 therebetween, or in a similar way, is located in the slots 33. After the strip 38 has been torn away, the slider 37 can be slid in order to release the opening 36.

In FIG. 5, the parts being connected to each other, e.g. by bonding, such as the parts 28, 29, 30 and 31, have been indicated by means of a hatching with dash-dot lines. The packing may be made of plastic or thin cardboard. The plastic may be transparent.

It will be obvious, that only some of the possible embodiments of a packing according to the invention have been illustrated in the drawing and described above, and that many modifications can be made without being beyond the inventive idea.

Thus, the packing, seen in cross-section, need not have the relatively flat shape illustrated in the drawings, but it can also be triangular or polygonal. The same holds for the shape of the longitudinal section. The only requirement is that the one wall 6, 32 respectively, is provided with slots 7, 33 respectively, for receiving the slider 8, 37 respectively therein, for closing off the opening 9, 36 respectively, in the packing unit 1, 23 respectively.

I claim:

1. Packing for small objects, comprising:

(A) a packing unit formed by a folded and joined plate of rigid material, the packing unit having at least one wall with an opening formed in one wall, to access an interior of the packing unit;

(B) at least two opposing slots formed on the one wall;

(C) a slider, formed from the plate of rigid material and slideably positioned within the opposing slots, such that the opening is releasably covered, wherein the slider is unitary with the packing unit; and (D) a breakable weakening line connecting the slider to the packing unit.

2. Packing according to claim 1, wherein the packing unit is made of plastic.

3. Packing according to claim 2, wherein the plastic is transparent.

4. Packing according to claim 1, wherein the slider is made of thin cardboard.

5. Packing according to claim 1, wherein the slider remains connected to the packing unit as long as the packing is not opened.

6. Packing according to claim 1, wherein the packing unit is made of thin cardboard.

7. Packing according to claim 1, further comprising a cover foil across the opening, removably connected to the at least one wall and partly fixedly connected thereto, such that the opening is covered as long as the packing is not used and is coverable by the cover foil after use.

8. Packing according to claim 7, wherein the cover foil is formed by an adhesive tape.

9. Packing according to claim 1, wherein the opening is tearable from the at least one wall.

10. Packing for small objects, comprising:

(A) a packing unit formed by a folded and joined sheet, the packing unit having at least one wall with an opening formed in one wall, to access an interior of the packing unit;

(B) at least two opposing slots formed on the one wall;

(C) a slider, formed of a plate of rigid material, slidably positioned within the opposing slots, such that the opening is releasably covered; and (D) a cover foil applied across the opening, partly removably connected to the one wall and partly fixedly connected to the one wall, such that the opening is covered as long as the packing is not opened and is re-coverable by the cover foil after opening.

11. Packing according to claim 10, wherein the cover foil (12) is formed by an adhesive tape.

12. Packing according to claim 10, wherein the packing unit is made of plastic.

13. Packing according to claim 12, wherein the plastic is transparent.

14. Packing according to claim 10, wherein the packing unit is made of thin cardboard.

15. Packing according to claim 10, wherein the slider is made of thin cardboard.

16. Packing according to claim 10, wherein the slider 13 connected to the packing unit as long as the packing is not opened.

17. Packing according to claim 10, further comprising a lip mounted to the slider and fixedly connected to the packing unit and tearable therefrom.

18. Packing according to claim 17, wherein the lip includes means for hanging up the packing.

19. Packing according to claim 10, further comprising a lip connected to the slider by a perforation.

20. Packing according to claim 19, wherein the lip includes means for hanging up the packing.

* * * * *